US006216497B1

(12) United States Patent
Miyata et al.

(10) Patent No.: US 6,216,497 B1
(45) Date of Patent: Apr. 17, 2001

(54) HEAT RETAINING KNIT FABRIC

(75) Inventors: Hiroyuki Miyata; Tsuyoshi Fujiwara, both of Osaka (JP)

(73) Assignees: Yugen Kaisha Fujiwara Kosan, Osaka; Kabushiki Kaisha Quadrille Nishida, Kyoto, both of (JP)

( * ) Notice: Subject to any disclaimer, the term of this patent is extended or adjusted under 35 U.S.C. 154(b) by 0 days.

(21) Appl. No.: 09/351,109

(22) Filed: Jul. 7, 1999

(51) Int. Cl.[7] ..... D04B 1/16
(52) U.S. Cl. ..... 66/202
(58) Field of Search ..... 66/169 R, 170, 66/171, 202, 196; 139/420 R, 420 A; 442/304, 311

(56) References Cited

U.S. PATENT DOCUMENTS 4,199,633 * 4/1980 Blore ..... 66/202
4,725,487 * 2/1988 Pemrick et al. ..... 66/202
5,217,495 * 6/1993 Kaplan et al. ..... 57/225
5,540,982 * 7/1996 Scholz et al. ..... 66/195
5,725,949 * 3/1998 Pasquali et al. ..... 66/202
5,998,025 * 12/1999 Kido et al. ..... 428/370
6,003,565 * 12/1999 Whittier, II et al. ..... 139/420 A
6,021,523 * 2/2000 Vero ..... 66/202

* cited by examiner

*Primary Examiner*—Danny Worrell
(74) *Attorney, Agent, or Firm*—Curtis L. Harrington

(57) ABSTRACT

A heat retaining knit fabric is comprised of a knit textile design for outer clothing exposed in an open air wherein heat is retained inside a knit structure and a dispersion of heat is prevented when using heat of wetting generating fiber which generates heat by water adsorption and steam adsorption in a interlock stitch of plating stitch comprising minute space surrounded by two kinds of yarn at the front and the back of each knitted loop in a knit-loop portion.

6 Claims, 1 Drawing Sheet

HEAT RETAINING KNIT FABRIC

BACKGROUND OF INVENTION

1. Field of the Invention

The present invention relates to a textile design of knit fabric (hereafter abbreviated as textile design) in order to bring out specific functions of yarn efficiently.

2. Description of the Related Art including information disclosed under 37 CF R 1.97 and 1.98

It has been known that fiber, such as natural fiber generates heat of adsorption when adsorbing moisture or steam. Also, wool and animal hair have been known as fibers in which heating value of wetting is rather high. As for an example, there is a report on heat of wetting of sheep wool, "Sheep wool: Secrets of Generating Heat When Getting Wet With Water" in page 5 of 'Industrial Material and Functional Fabric' as hand out materials of an open seminar by Japan Fabric Machinery Society in Jul. 6, 1984.

While advocating said function as heat of wetting generating of synthetic fiber, the textile design of fabric disclosed in the present invention has to generate a few times as much of heat value of wetting as wool because in general, wool has not been identified as a heat of wetting generating fiber. Therefore, fiber with as much heat building-up as wool is not generally identified as a fiber possessing a heat of wetting generating function, rather, it is only now expressing this characteristic as if this function is a new function.

Synthetic fiber of the polyacrylate series has been known as one kind of synthetic fiber which generates heat by water adsorption or steam adsorption. Polyacrylate indicates polymer of acrylic acid or polymerizated ester of acrylic acid.

Therefore, from this point of view, all kinds of polyacrylate do not possess the heat of wetting generating function. Since fiber in polymer of acrylic acid soda series classified in polyacrylate has 2 to 3 times as much heat of wetting generating function as wool, said fiber can be said to possess the heat of wetting generating function.

If certain fiber has such heat of wetting generating function, it generates heat with moisture content from sweating when worn and with moisture content of steam in such a surrounded atmosphere, and therefore, the generated heat can be felt on the skin.

Yet in order to make fiber using acrylic acid soda polymer series as a base, this limitation cannot be made only to simple fiber in acrylic acid soda of polymer series because of a restriction in making fiber and polymer plans such as making polymer easy to swell with water adsorbing function and restraining the swelling function whilst leaving the water adsorbing function. Therefore, the base of fiber in the present invention is expressed as a polyacrylate series fiber with the heat of wetting generating function.

Using these kinds of fiber with the heat of wetting generating function as a heat retaining material in batting and lining has been made public in prior art such as Tokkaihei-6-294006. Basically, retaining of heat is a purpose when using these kinds of fiber in related materials of batting since these kinds of fiber comprise primarily a structure wherein the heat of wetting does not easily disperse and have an additional effect of the heat of wetting in generating heat of wetting with moisture content from sweating when worn.

Further, if the heat of wetting generating fiber is used in products such as underclothing and mufflers, with their purpose being the retaining of heat, are also worn in order to protect heat from dispersion, the additional advantages of the effects of the heat of wetting can be obtained.

Similarly, since a lining made out of the heat of wetting generating fiber is also used inside of outer clothing, the same effect as above can be expected.

After all, most fiber products with their main purpose being heat retaining within their structure or in ways of wearing are those which aim to obtain the additional effect of heat of wetting by using the heat of wetting generating fiber partly in the existing circumstances.

Generation of heat caused by the heat of wetting generating fiber with moistness is known as heat generated by adsorption wherein water being in a different state from normal free water adsorbed and fixed inside the heat of wetting generating fiber when the water immerses in the fiber. In a case of steam, condensation heat of steam is added to this.

The heating value of wetting generated by fiber of polyacrylate series with the heat of wetting generating function is about 1400 J (335 cal) per 1 g of the fiber in an atmosphere of 25° C., 80% RH, which is very small value being about 5% of the heating value, 2500 J (6000 cal), which would be generated in combustion of such fiber.

This value can only be obtained under an ideal situation. It gets much less an amount with an effect of water cooling caused by lacking of moistness, by excess of moistness or with endothermic reaction of latent heat of evaporation.

Therefore, promoting the heat of wetting generating fiber becomes meaningless unless it is a fiber product which is planned with the consideration that the generation of heat will be very small.

Fiber products comprising a structure aiming at retained heat with the additional effect of generated heat of wetting by using the heat of wetting generating fiber, wherein a very small amount of generated heat of wetting with moisture of sweating can be used as effective as it can be, are such clothing products protecting from coldness which comprise a structure preventing a dispersion of heat or are worn in order to prevent dispersion of heat.

In spite of that, the dispersion of heat cannot be avoided in a case of using the heat of wetting generating fiber as outer clothing like sweaters and vests because the clothing is exposed to the open air directly.

Particularly in a case of a knit fabric, the most of additional effect of the generated heat of wetting would not appear simply with swapping a normal yarn with a yarn made out of the heat of wetting generating fiber since the structure of a knit fabric is rather rough when comparing to a woven fabric.

Therefore, as for a knit fabric for outer clothing which is exposed to the open air directly, an invention of a knit fabric structure wherein the generated heat of wetting can be added effectively when using the heat of wetting generating fiber as in using a yarn.

BRIEF SUMMARY OF THE INVENTION

A devoted investigation of a knit textile design wherein minute air is connoted within an inside structure of knit fabric and the dispersion of heat can be avoided even when using the heat of wetting generating fiber as outer clothing like sweaters and vests, being exposed to the open air directly, has come to be employed in the present invention.

In other words, the present invention discloses a knit fabric comprising blended yarn of a polyacrylate series fiber which generates heat by water adsorption or moisture adsorption and portions wherein such yarn is used for interlock stitch, plating stitch or commonly used stitch of interlock stitch and plating stitch.

In producing such knit fabric, a minute space made with two kinds of yarn at the front and the back which are almost on a parallel and are formed and distributed twice as much as number of stitches within the whole knit fabric within a knit-loop portion of inner part of the knit fabric in order to make a structure which prevents the dispersion of the generated heat of wetting as heat of wetting generating fiber from the knit fabric.

According to the present invention, there are the following effects.

(1) The present invention, in a case of using the polyacrylate series fiber with the function of generating heat of wetting as outer clothing such as sweaters and vests, catches the generated heat of wetting occurred with steam and moisture of sweat of person wearing the knit fabric and the surrounding within the minute space in order to make the generated heat of wetting higher, even when the knit fabric is exposed to the open air, because it has many minute spaces within the knit-loop portion comprised of two kinds of yarn at the front and the back within each knitted loop of the knit structure design.

(2) Because the temperature dropping rate of the knit fabric raised by the function of generating heat of wetting is low, the retaining ability of heat is high.

(3) The blending of the polacrylate series fiber with the function of generating heat of wetting and wool being added with the function of generating heat of wetting found in wool displays effective heat generation and heat retaining action even with a low blending ratio of the polyacrylate series fiber.

The knit fabric of the present invention which comprises the structure wherein generated heat is effectively captured and prevents the dispersion of heat by combining heat of wetting generating yarn into the knit textile design has a great applicability in developing industries because it can be applied in a usage of outer clothing apart from ordinarily used clothing against cold, underwear and socks with their purpose being retaining of heat.

DETAILED DESCRIPTION OF THE INVENTION

Made with a weft knitting machine with double-needled base, textile designs of rib stitch and its derivative stitch and textile designs of interlock stitch and its derivative stitch are called double knit wherein a basic stitch design for the present invention with a connection of two half-gauge of rib stitch which is equivalent to interlock stitch organized with crossing from both sides by a circular knitting machine and the weft knitting machine, are also called interlock and double-rib. As for an outside look of the basic stitch design, it looks like front stitches of plain stitch at both the front and the back.

Figure 1:
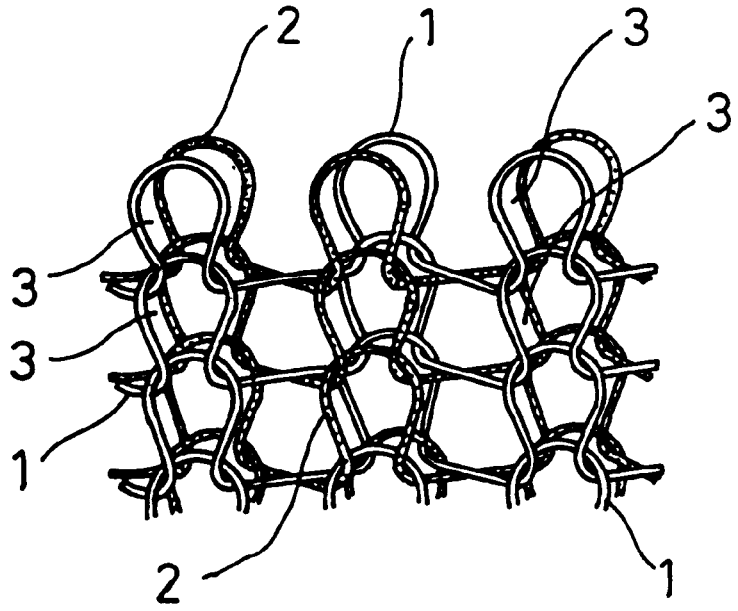
FIG. 1 is a brief sketch of a basic interlock stitch textile design of double knit fabric comprising heat of wetting generating fiber.

@ @ FIG. 1 shows a brief sketch of the textile design of basic stitch in the present invention. Both or one of the use of yarn 1 (void line) and use of yarn 2 (bold line) are heat of wetting generating yarns in which a blending of the heat of wetting generating fiber.

A knit-loop means a loop which has been made by going through a loop procedure. At the knit-loop portion in FIG. 1, a minute space 3 which is almost on a parallel is formed with its surrounding using yarn 1 which is one of yarn faced each other at the front and the back and using yarn 2 which is the other of yarn faced each other at the front and the back.

The number of such minute space is so large within the knit fabric wherein twice as much of such minute space as knitted loops exist.

The knitting loop textile design of FIG. 1 is drawn with thin lines so that it is easily understood. A characteristic of this knit textile design of interlock stitch is that it has a elasticity with the knitted loops being minute and its minute space 3 within the knit-loop portion with two kinds of using yarn 1 and 2 becomes like a structure with a closed space within an actual knit fabric wherein spinning yarn is used because of a shrinkage by hanks, a swell of yarn and fluff.

This textile design of knitted loops catches the heat of wetting generated by using yarn, i.e. heated air, inside the minute space and enhances a heat retaining ability by preventing the dispersion of heat.

Particularly, in a case of using bulked yarn which is made with heat contracting blended fiber of acrylic fiber, the heat retaining ability is enhanced further as the yarn itself contains a lot of air.

The textile design of basic knit are applied to the following textile designs of knit: interlock stitch wherein drawing off is applied; eight-lock; many-barred interlock stitch with three or four bars; interlock stitch wherein tuck is applied (i.e. single-pique, mock-single-pique, royal interlock, texy-pique, tuck-ripple); transparent stitch wherein tuck is applied to interlock stitch; three-barred interlock stitch wherein tuck is applied; interlock stitch wherein welt is applied (i.e. mock-milanese-rib, mock-royal-interlock, cross-miss-interlock, piquet (mock roddy), welt-ripple); check patterned interlock stitch; interlock stitch wherein tuck and welt are applied; and interlock stitch wherein inlay is applied. All these textile design with some applications can be used in the embodiments of the present invention optionally as they comprise minute spaces almost on a parallel surrounded by two kinds of yarn in the knit-loop portion.

Figure 2:
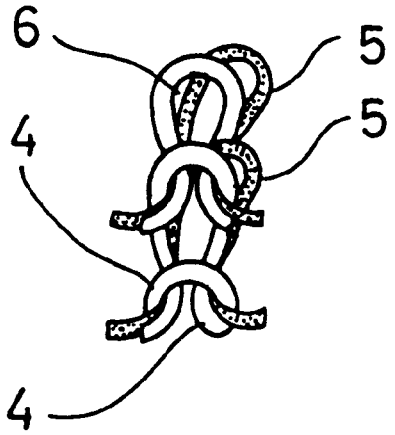
FIG. 2 is a brief sketch of a basic plating stitch textile design of double knit fabric comprising heat of wetting generating fiber.

FIG. 2 sows a brief sketch of a knit textile design of weft knit which is an another textile design of the basic knit designs in the present invention.

In other words, it is double knit like stitch wherein two different kinds of yarn are put into a double-hole yarn supply port of a knitting machine with a single-needled base respectively and the yarn at the front and the back consist a totally different knit design.

The yarn which is closed to a head of the needle positions itself in front of a hook appears only at the back side when a knitted loop is taken off.

Both or one of using yarn 4 (void line) and using yarn 5 (bold line) are heat of wetting generating yarn which are a blending of the heat of wetting generating fiber. If the former (using yarn 4) appears at the front, the latter (using yarn 5) appears at the back.

At the knit-loop portion in FIG. 2, minute space 6 which is almost on a parallel is formed with surrounding using yarn 4 and 5.

The number of this minute space is so large within the knit fabric as there are twice as much of such minute space as knitting loops.

Within an actual knit fabric wherein spinning yarn is used, the minute space 6 becomes like a structure with a closed space, because of a shrinkage by hanks of fiber, a swell of yarn and fluff. This textile design of knitted loop is the same as the case of the interlock stitch textile design indicated in FIG. 1 at the point that this design of stitches catches the heat of wetting generated by using yarn, i.e. heated air, inside the minute space, enhances the heat retaining ability by preventing the dispersion of heat.

All applied textile designs of plating stitch such as spiral-mesh stitch and boss-neck pattern stitches are applied textile designs of said basic stitch comprise minute space almost on a parallel surrounded by two kinds of yarn at the knit-loop portion, thus these can be used optionally in embodiments of the present invention.

Also, it is natural to think that a common used stitch of interlock stitch and platting stitch can be used.

The polyacrylate series fiber comprising the heat of wetting generating function which are to be used in the present invention does not have enough properties of matter such as strength.

Even with the heat of wetting generating function, 100% "of this intentional yarn and 100%" of its fabric may not be favorable as clothing because of their lacking of strength, stickiness, and its style and feeling of moisture coming from good water absorptivity.

Therefore, the polyacrylate series fiber comprising the heat of wetting generating function is mixed with supplemental fiber like natural fiber, cellulose semi-synthetic fiber and synthetic fiber and is used as blended yarn mixed with two kinds or with three kinds of fiber.

The lower limit percentage of blending the polyacrylate series fiber comprising the heat of wetting generating function is hard to set, but it is supposed to be about 10% when the supplemental fiber is wool and is about 20% when the supplemental fiber is the other kinds of fiber. The lower limit percentage of blending the supplemental fiber which should be set optionally according to its usage, is thought to be about 40%~50% substantially.

In blending the polyacrylate series fiber comprising the heat of wetting generating fiber, there are many choices in choosing the supplemental fiber according to the usage and the target season. Yet, in a case of supplying the properties of matter of heat of wetting generating fiber, wool as been found to be the most appropriate in particular.

The polyacrylate series fiber generating about 1400 J (350 cal) of heat per 1 g of its quantity under the above mentioned certain condition. On the contrary, wool, a kind of natural fiber generating heat of wetting which generates about 500 J (120 cal) of heat per 1 g of its quantity supplies not only strength but also heat as a property of matter. Within interlock stitch and plating stitch of the present invention, by using wool as a supplemental fiber, the fiber existing all around the minute space which is surrounded by two kinds of yarn at the front and the back formed in the knit-loop portion is made to generate heat. Therefore, it can be said that it is very effective in catching the generated heat.

The next part shows examples in a case of using the polyacrylate series fiber as embodiments.

As for heat of wetting generating fiber, the polyacrylate series fiber which generates about 1400 J per 1 g of its quantity under 25° C. 80% high humidity atmosphere is used and examined.

The nature of polyacrylate series fiber used in the present embodiments will indicate heat of wetting generating polyacrylate series fiber hereinafter.

In the embodiments of the present invention, a fabric made with spun yarn of the 100% polyacrylate series fiber certainly has a function of preventing the dispersion of heat of wetting. However, the strength of the polyacrylate series fiber is so weak that the spun yarn of 100% polyacrylate series fiber cannot be used for clothing. Moreover, it is not favorable as clothing because of its style and feeling of moisture coming from good water adsorptivity and stickiness.

The relationship among a trial manufacture of yarn mixed with representative fiber, a trial manufacture of knit fabric and generated heat of wetting is examined because another kinds of fiber should be mixed in order to cover such defects.

First, wool, cotton and polyester were chosen as blending fiber in order to examine the relationship among th polyacrylate series fiber, the blending ratio and generated heat of wetting.

0 (i.e. 100% of another fiber), 10, 20, 30, 40 and 50% of the polyacrylate series fiber as for the blending ratio were manufactured on trial with the wool and its blended yarn which was 48 metric yarn count, two folded yarn (2/48 Nm) in a worsted spinning method, and with the cotton and polyester, and their blended yarn which were 30 cotton yarn count, two folded yarn (30/2 CC) in a cotton yarn spinning method respectively.

A knit fabric comprising the plating stitch textile design with its quantity 290 g/m$^2$ was made with the yarn on trial by the weft knitting machine comprising the single-needled base with its inch-interval being 12 gauge as indicated in FIG. 2.

In evaluating a heat generation and a heat retaining ability, firstly each test sample was moved under a 20 Ž, 90 "RH high humidity environment after drying and cooling at 60 Ž for 20 hours and then states of the test samples were photographed with a thermograph when the test samples generated heat by adsorbing moisture from immediately after they were moved till 5 minutes later, and their surface temperatures were compared one minute after the movement was made when they were at almost the highest temperature. Additionally, the termography was taken with a decision wave length at 8~13 $\mu$m and an emissivity at 1.

As for each test sample with the polyacrylate series fiber at blending ratio 0, 10, 20, 30, 40 and 50%, the results of the knit fabric surface temperature at blending ratio of 0~50% orderly are as follows:

WOOL MIXED YARN 24.3, 25.2, 25.7, 26.2, 26.8, 27.4° C.

POLYESTER MIXED YARN 22.5, 23.4, 24.0, 24.7, 25.0, 25.3° C.

COTTON MIXED YARN 23.2, 24.0, 24.6, 25.1, 25.7, 26.1° C.

This result of the examination shows that wool compared to polyester and cotton, seems to generate comparatively high temperature heat when a blending of polyacrylate series fiver is 0% (i.e. the supplemental fiber 100%) and to generate high temperature heat with the blending ratio of the polyacrylate series fiber at about 10% and more. What is obvious from the result is that wool comprises a supplemental ability for generating heat in addition to a supplemental ability for properties of matter and a fashion.

On the contrary, it has been found out that the polyacrylate series fiber with the blending ratio around 30~40% is necessary for polyester and cotton in order to obtain the same temperature as what wool blended with 10% of the polyacrylate series fiber gets. Secondarily, the knit fabric was examined using the polyacrylate series fiber which generates about 1400 J per 1 g of its quantity under a 25° C., 80% high humidity atmosphere.

48 metric yarn count, two folded yarn (2/48 Nm) in the worsted spinning method as a test was manufactured with yarn comprising 30 "of the polyacrylate series fiber (symbol A) and 70 "of sheep's wool (symbol W) by the blending ratio, and with W 100%.

30 cotton yarn count, two folded yarn (30/2 CC) count in the cotton yarn spinning method as a test was manufactured with yarn comprising A 30% and 70% of cotton (symbol C) by the blending ratio, and with C 100%.

The knit fabric of the present invention was manufactured on trial using said yarn. One of the knit fabric was manufactured on trial by the weft knitting machine comprising the double-necked base with its inch-interval being 12 gauge per one side of needled base as indicated in FIG. 1.

Also, another knit fabric of the present invention was manufactured on trial by the weft knitting machine comprising the single-needled base with its inch-interval being 12 gauge as indicated in FIG. 2.

As for a comparative test sample, a cylindrical fabric comprising plain stitch was made by the weft knitting machine comprising the double-needled base with its inch-interval being 12 gauge.

These fabrics as evaluative test samples were boiled off and oiled, and then dried as a finish. In a step of finish, a quantity of stripe fabric in each test sample was made to be in the range of 280~300 g/m$^2$.

In evaluating the heat generation and the heat retaining ability, firstly each test sample was moved under a 20%, 90% RH high humidity environment after drying and cooling at 60° C. for 20 hours and then states of the test samples were photographed with a thermograph when the test samples generated heat by adsorbing moisture, from immediately after they were moved until they were in a stable state. Photographed sides of the fabrics were sides comprising the heat of wetting generating fiber. Additionally, the thermograph was taken with a detection wave length at 8~13 $\mu$m and a emissivity at 1.

The relationship between detailed evaluation of the fabric and the surface temperatures of the test samples is shown in table 1.

TABLE 1

| SYMBOL | ① | ② | ③ | ④ | ⑤ | ⑥ | ⑦ | ⑧ |
|---|---|---|---|---|---|---|---|---|
| ORGANIZATION | inter-lock stitch | inter-lock stitch | inter-lock stitch | inter-lock stitch | plating stitch | plating stitch | plain stitch × 2 | plain stitch × 2 |
| COUNT | 2/52 Nm | 2/52 Nm | 30/20 C | 30/20 C | 2/48 Nm | 30/20 C | 2/48 Nm | 30/20 C |
| FRONT YARN | W 70% A 30 | W 100% | C 70% A 30 | C 100% | W 100% | C 100% | W 100% | C 100% |
| BACK YARN | W 70% A 30 | W 70% A 30 | C 70% A 30 | C 70% A 30 | W 70% A 30 | C 70% A 30 | W 70% A 30 | C 70% A 30 |
| IMMEDIATELY AFTER MOVEMENT | 25.5° C. | 24.8° C. | 24.7° C. | 24.1° C. | 24.8° C. | 23.9° C. | 23.8° C. | 23.2° C. |
| AFTER 1 MIN. | 26.4° C. | 25.8° C. | 25.1° C. | 24.9° C. | 25.5° C. | 24.7° C. | 24.6° C. | 23.8° C. |
| AFTER 5 MIN. | 26.1° C. | 25.4° C. | 24.8° C. | 24.3° C. | 25.3° C. | 24.5° C. | 24.3° C. | 23.3° C. |
| AFTER 10 MIN. | 25.8° C. | 25.2° C. | 24.8° C. | 24.1° C. | 25.0° C. | 24.1° C. | 23.0° C. | 22.8° C. |
| AFTER 20 MIN. | 25.6° C. | 24.8° C. | 24.1° C. | 23.9° C. | 24.7° C. | 23.7° C. | 22.5° C. | 22.1° C. |
| TEMPERATURE DROPPING RATE | 3.0% | 3.9% | 4.0% | 4.0% | 3.1% | 4.0% | 8.5% | 7.1% |

Descriptions of 'plain stitch×2 of symbols ⑦, ⑧ in the 1st rank of Table 1 is the cylindrical fabric (a fabric comprising two pieces of plain stitched fabric combined at the back) and is a comparative test sample against the fabric of the present invention symbolized ①~⑥. It is also a normal knit fabric without the minute space made with parallel two kinds of yarn at the front and the back in the knit-loop portion, and is a test sample wherein the thickness and quantity per unit are added into the fabrics symbolized as ①~⑥.

Descriptions of numerical value %" in the 4th and 5th ranks of Table 1 indicate blending ratio of yarn. Also, descriptions of numerical value ° C. in the 6th~10th ranks of Table 1 indicate the surface temperatures of test sample fabrics which are accordance with the passage of time after the movement made into a high humidity circumstance.

The last rank of Table 1 is temperature dropping rate of surface temperature from the highest temperature till a temperature of 20 minutes after, and is calculated with an equation as follows:

Temperature dropping rate={(temp. of 1 min. after)−(temp. of 20 min. after)/temp. of 1 min. after}×100%

The value becomes lower with the less dispersion of heat, i.e. a good retaining ability of heat.

According to Table 1, the knit fabric of the present invention, i.e. fabric ①~④ comprising an interlock stitch textile design, and fabrics, ⑤, ⑥ comprising the plating-stitch textile design obviously have high surface temperature of knit fabric and low temperature dropping rate, i.e. high ability of heat supply when compare to fabrics ⑦ and ⑧ comprising the plain-stitch textile design when using the same supplemental fiber and the same usage of yarn.

The difference of the surface temperature between a fabric ② of the present invention and a comparative fabric ⑦ in a case of blending wool, and the difference of surface temperature between a fabric ④ of the present invention and a comparative fabric ⑧ in a case of blending cotton indicates that the generating heat of wetting is effectively supplied and that the dispersion of heat is prevented with the minute space surrounded by two parallel two kinds of yarn in the knit-loop portion within the fabric comprising the interlock stitch textile design and the plain-stitch textile design.

Also, within the test sample fabrics ①~⑥, both fabrics comprising the interlock stitch textile design and the plain-stitch textile design indicates that knit fabric mixed with wool has higher surface tempreture and lower temperature dropping rate than knit fabric mixed with cotton.

In other words, if it is to indicate mixing of wool versus mixing of cotton, these test samples are: ① verses ③; and ② and ⑤ verses ④, wherein the knit facbric mixed with wool has higher surface temperature and lower temperature dropping rate than the knit fabric mixed with cotton.

Furthermore, if one of ②, ④~⑥ comprises the heat of wetting generating yarn when compared to ① and ③ which comprise a pair of knitted loops in both of the front and the back of knit fabric which are consisted with the heat of wetting generating yarn, ②, ④~⑥ comprise one other characteristics of the present invention with no large difference even though the surface temperature is a little lower than that of ① and ③. Therefore, in each knitted loop, it can be said that there is an effect of the present invention even with one of two kinds of yarn at the front and the back side being heat of wetting generating yarn and the other being a normal yarn.

The following is to briefly explain the numerical marks in the drawings.

"1" is the use of yarn, which is faced each other at one of the front and the back.

"2" is the use of yarn, which is faced each other at the other of the front and the back.

"3" is a minute space surrounded by using yarn 1 and 2 in a knit-loop portion.

"4" is the use of yarn which comes on the front surface of a fabric.

"5" is the use of yarn which comes on the back surface of a fabric.

"6" is a minute space surrounded by using yarn 4 and 5 in a knit-loop portion.

What is claimed is:

1. A heat retaining knit fabric comprising yarn blended with polyacrylate series fiber which generates heat by water adsorption and steam adsorption wherein said yarn is used in an at least one of an inter-lock stitch, a plating stitch and a combination of said interlock stitch and said plating stitch, as a type of double knit fabric.

2. A heat retaining knit fabric as set forth in claim 1 comprising a front stitch of a first type of yarn and a back stitch of a second type of yarn and wherein at least one of said first and second type of yarn is blended with polyacrylate series fiber to generate heat by water adsorption and steam adsorption.

3. A heat retaining knit fabric as set forth in claim 1 comprising wool blended with at least one of said first and second type of yarn which is blended with polyacrylate series fiber to generate heat by water adsorption and steam adsorption.

4. A heat retaining knit fabric as set forth in claim 2 comprising wool blended with at least one of said first and second type of yarn which is blended with polyacrylate series fiber to generate heat by water adsorption and steam adsorption.

5. A heat retaining knit fabric as set forth in claim 3 wherein a blending ratio of polyacrylate series fiber which generates heat by water adsorption and steam adsorption in blended yarn is from about 10% to about 30%.

6. A heat retaining knit fabric as set forth in claim 4 wherein a blending ratio of polyacrylate series fiber which generates heat by water adsorption and steam adsorption in blended yarn is from about 10% to about 30%.

* * * * *

UNITED STATES PATENT AND TRADEMARK OFFICE

CERTIFICATE OF CORRECTION

PATENT NO. : 6,216,497 B1
DATED : April 17, 2001
INVENTOR(S) : Hiroyuki Miyata & Tsuyoshi Fujiwara It is certified that error appears in the above-identified patent and that said Letters Patent is hereby corrected as shown below:

Column 1,
Line 14, before "wool" please cancel "sheep".
Lines 17-18, please cancel "Japan Fabric Machinery Society" and insert -- The Textile Machinery Society of Japan -- therefor.

Column 7,
Line 34, before "wool" please cancel "sheep".

Table 1,
Between columns 7&8; columns 3,4,6, & 8, please cancel "30/20 C" and insert -- 30/2CC -- therefore.

Column 6,
Line 36, please cancel "20 Z, 90 "RH" and insert -- 20°C, 90% RH --
Line 37, please cancel "60 Z" and insert -- 60°C --

Signed and Sealed this

Thirteenth Day of November, 2001

*Attest:*

Nicholas P. Godici

NICHOLAS P. GODICI
*Acting Director of the United States Patent and Trademark Office*

*Attesting Officer*